US005642680A

United States Patent [19]

Thompson et al.

[11] Patent Number: 5,642,680

[45] Date of Patent: Jul. 1, 1997

[54] AUTOMATIC CUFF SETTER

[75] Inventors: Ken J. Thompson, Lexington; John R. Everhart, Winston-Salem; Wayne G. Foster, Winston-Salem; David S. Trotter, Winston-Salem, all of N.C.

[73] Assignee: Sara Lee Corporation, Winston-Salem, N.C.

[21] Appl. No.: 505,404

[22] Filed: Jul. 21, 1995

[51] Int. Cl.[6] ..... D05B 21/00

[52] U.S. Cl. ..... 112/470.14; 112/475.07; 112/475.09

[58] Field of Search ..... 112/470.06, 470.08, 112/470.09, 470.14, 470.15, 475.04, 475.07, 475.09, 475.12

[56] References Cited

U.S. PATENT DOCUMENTS 4,881,477 11/1989 Gazzarini ..... 112/470.15
4,957,054 9/1990 Sakuma et al. ..... 112/475.09 X
5,406,900 4/1995 Schramayr et al. ..... 112/475.09 X
5,419,268 5/1995 Fyler et al. ..... 112/470.14
5,505,149 4/1996 Schramayr et al. ..... 112/475.09 X

*Primary Examiner*—Paul C. Lewis
*Attorney, Agent, or Firm*—Rhodes Coats & Bennett, L.L.P.

[57] ABSTRACT

An apparatus for automatically setting a cuff to a garment piece for a sweat suit or the like. The apparatus includes a holding fixture for holding the cuff in the garment piece prior to sewing. A transfer system then moves the cuff and garment piece together to the sewing machine. The apparatus also includes a cuff setter having an elongated tube for receiving the garment piece over the front end of the tube and a spreader assembly for moving the cuff and garment piece together in the direction of sewing to attach the cuff to the garment.

46 Claims, 10 Drawing Sheets

AUTOMATIC CUFF SETTER

BACKGROUND OF THE INVENTION (1) Field of the Invention

The present invention relates generally to automated manufacturing systems and, more particularly, to an apparatus for automatically setting a cuff to a sleeve or pant leg for a sweat suit or the like.

(2) Description of the Prior Art

The manufacture of textile clothing articles such as sweat suits and outer garments has resisted automation. This is due largely because of the difficulty in accurately handling so called "soft" materials. For example, the fleece material commonly used in sweat suits may wrinkle, stick to one another and stretch significantly when handled.

Even where automation has begun to make in-roads, other difficulties remain. For example, cuffs for sleeves and pant legs for sweat suits or the like must be manually placed and sewn to set the cuff. This has always been a manual operation because of the dexterity required to position the cuff properly prior to sewing. Unfortunately, repetitive actions such as setting a cuff to a garment may cause health problems. However, it has been extremely difficult to design a device which can reliably position the cuff and sew it time after time.

Thus, there remains a need for an apparatus for automatically setting a cuff to a sleeve or pant leg for a sweat suit or the like which will operate reliably time after time while, at the same time, can be carried out completely automatically without the need for a skilled operator.

SUMMARY OF THE INVENTION

The present invention is directed to an apparatus for automatically setting a cuff to a sleeve or pant leg for a sweat suit or the like. The apparatus includes a holding fixture for holding the cuff in the garment piece prior to sewing. A transfer system then moves the cuff and garment piece together to the sewing machine. In the preferred embodiment, the transfer system includes a first pickup means attached to the frame for engaging the cuff and the garment piece adjacent to the cuff and a second pickup means attached to the frame for engaging the garment piece opposite the cuff. The apparatus also includes a cuff setter having an elongated tube for receiving the garment piece over the front end of the tube and a spreader assembly for moving the cuff and garment piece together in the direction of sewing to attach the cuff to the garment.

Accordingly, one aspect of the present invention is to provide an apparatus for automatically setting a cuff to a garment piece by a sewing machine for a sweat suit or the like. The apparatus includes: (a) a transfer system for moving the cuff and garment piece to the sewing machine; and (b) a cuff setter including an elongated tube having a front end and a rear end for receiving the garment piece over the front end of the tube and a spreader assembly for moving the cuff and garment piece together in the direction of sewing to attach the cuff to the garment.

Another aspect of the present invention is to provide a transfer system for an apparatus for automatically setting a cuff to a garment piece by a sewing machine for a sweat suit or the like for moving the cuff and garment piece to the sewing machine. The apparatus includes: (a) a frame; (b) a first pickup means attached to the frame for engaging the cuff and the garment piece adjacent to the cuff; and (c) a second pickup means attached to the frame for engaging the garment piece opposite the cuff, whereby the first and second pickup means cooperate to move the cuff and garment piece together to the sewing machine.

Still another aspect of the present invention is to provide an apparatus for automatically setting a cuff to a garment piece by a sewing machine for a sweat suit or the like. The apparatus includes: (a) a holding fixture for holding the cuff in the garment piece prior to sewing and (b) a transfer system for moving the cuff and garment piece to the sewing machine. The transfer system includes: (i) a frame; (ii) a first pickup means attached to the frame for engaging the cuff and the garment piece adjacent to the cuff; and (iii) a second pickup means attached to the frame for engaging the garment piece opposite the cuff, whereby the first and second pickup means cooperate to move the cuff and garment piece together to the sewing machine. The apparatus also includes: (c) a cuff setter including an elongated tube having a front end and a rear end for receiving the garment piece over the front end of the tube and a spreader assembly for moving the cuff and garment piece together in the direction of sewing to attach the cuff to the garment.

These and other aspects of the present invention will become apparent to those skilled in the art after a reading of the following description of the preferred embodiment when considered with the drawings.

DESCRIPTION OF THE PREFERRED EMBODIMENTS

Figure 1:
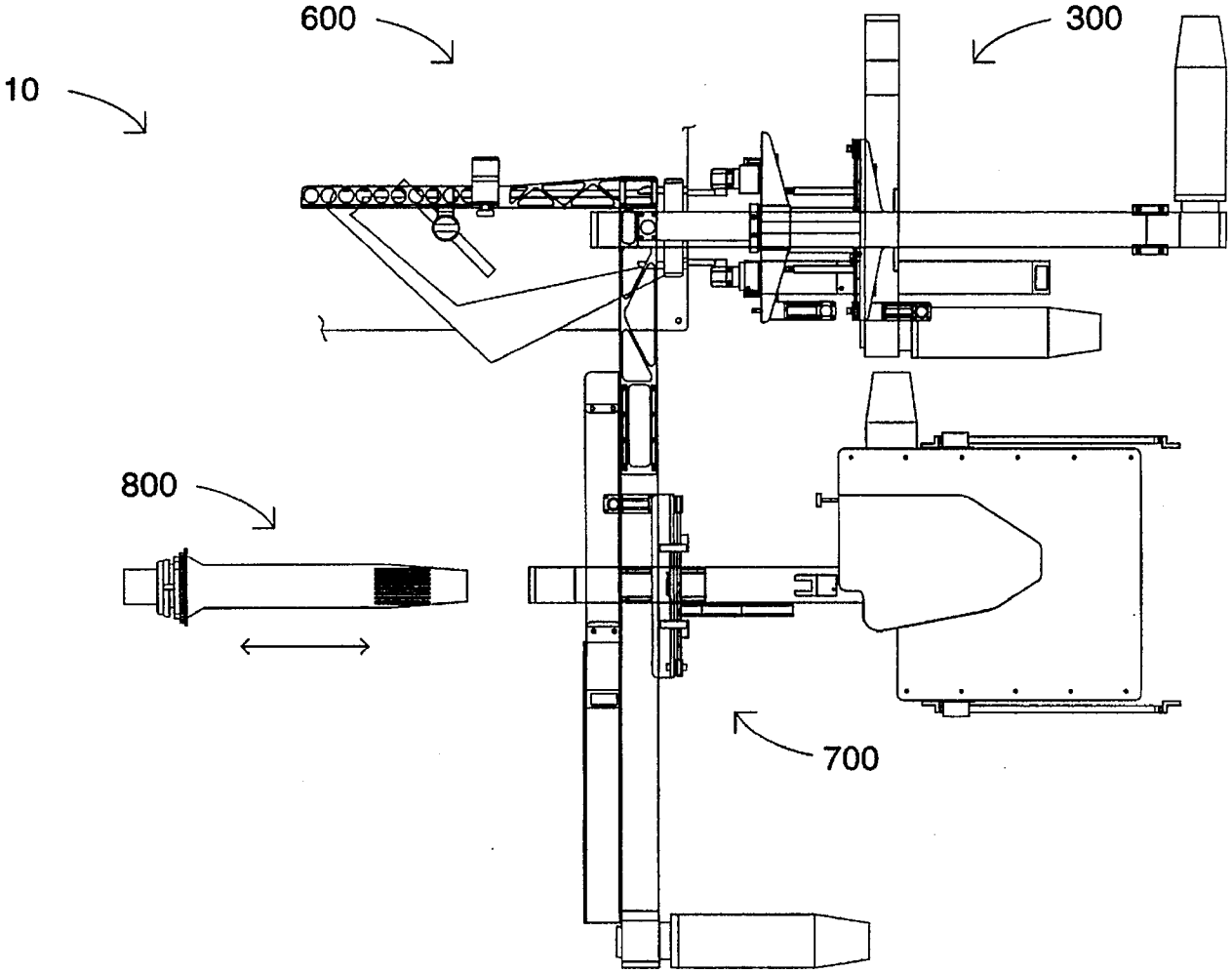
FIG. 1 is a top plan view of an automatic cuff setter constructed according to the present invention including a holding fixture for holding the circular cuffs and positioning a cuff in the garment piece prior to sewing; a transfer system for moving the garment piece and cuff together to a cuff setter for sewing; and a cuff setter including a sewing machine and an elongated tube and spreaders for sewing the cuff to the garment piece.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, an apparatus for automatically setting a cuff, generally designated 10, is shown constructed according to the present invention. The automatic cuff setter 10 includes three major sub-assemblies: a holding fixture 300 for holding the circular cuffs and positioning the cuffs in the garment piece prior to sewing; a transfer system 600 for moving the garment piece to a cuff setter 700 for sewing. The cuff setter 700 including a sewing machine and an elongated tube and spreaders 800.

Figure 2:
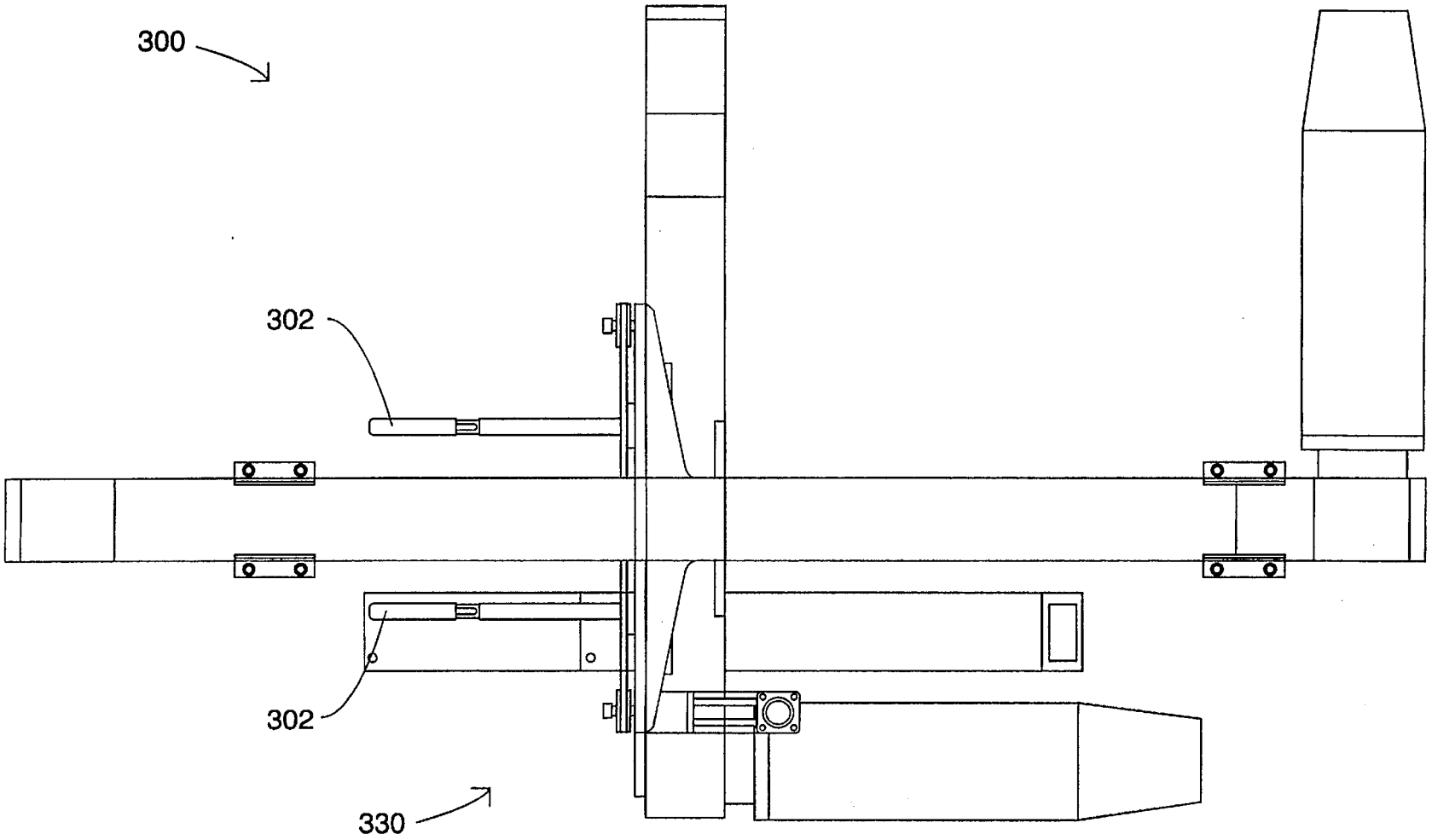
FIG. 2 is an enlarged top plan view of the holding fixture.
Figure 3:
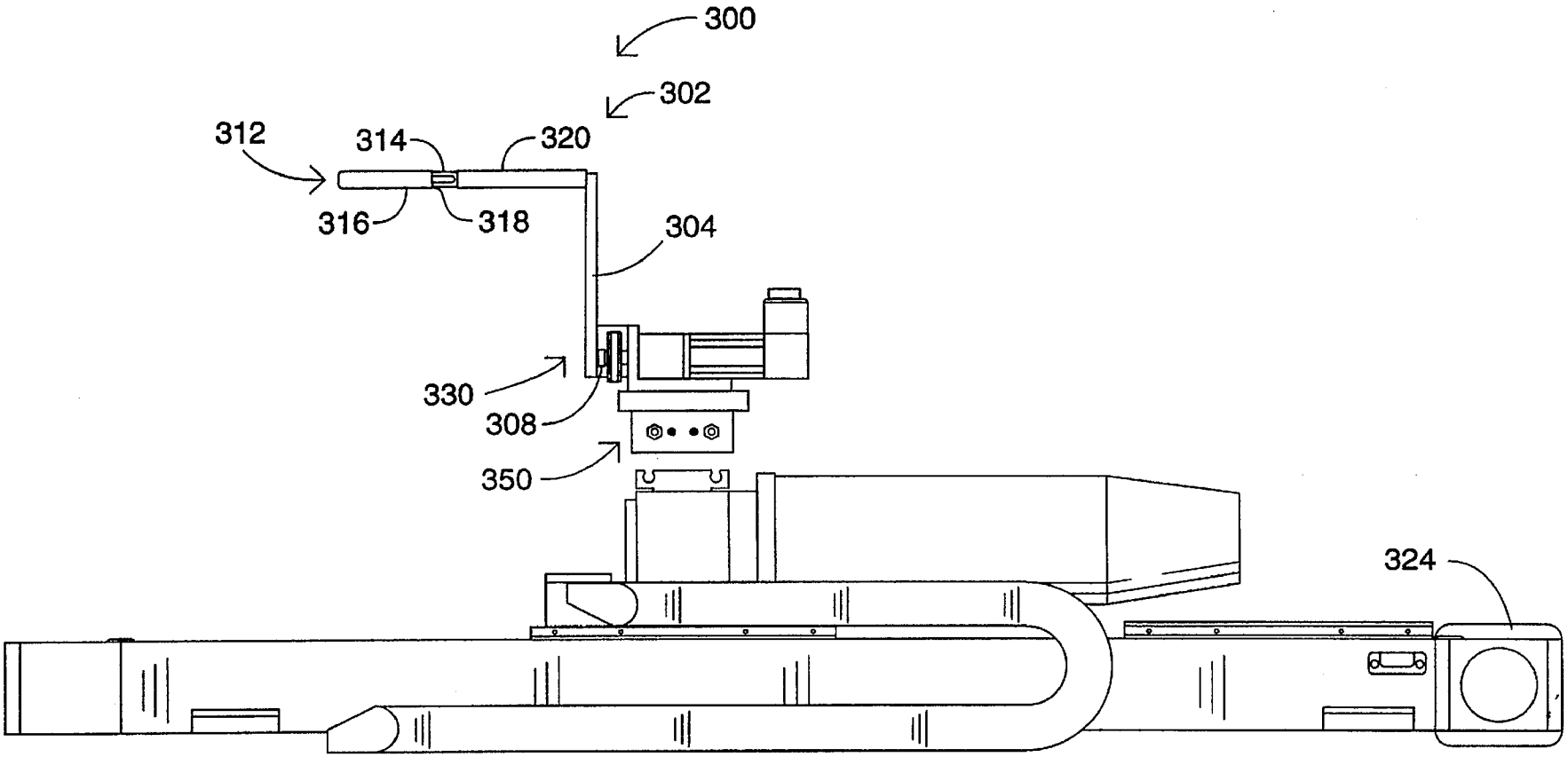
FIG. 3 is an enlarged side elevation view of the holding fixture.
Figure 4:
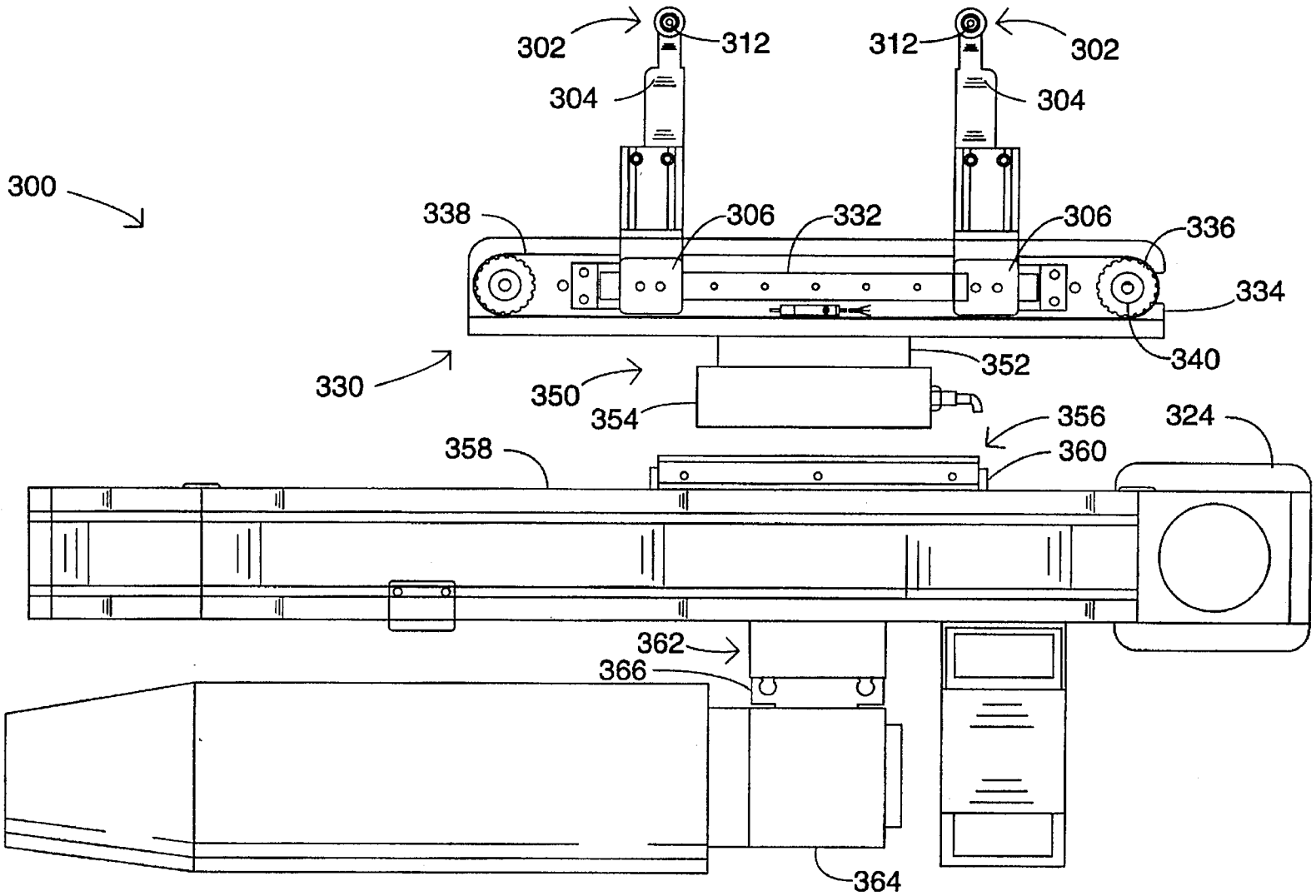
FIG. 4 is an enlarged front elevation view of the holding fixture.

The holding fixture 300, shown in FIGS. 2–4, receives and holds the circular cuffs for placement into the garment piece. The transfer system 600, shown in FIGS. 5–7, moves the garment piece and circular cuffs together to a sewing machine station for sewing into the garment piece. The cuff setter 700, shown in FIGS. 8–10, sews the garment piece and circular cuffs together. The cuff setter 700 includes a sewing machine and an elongated tube and spreaders 800 to remove the cuff and garment piece from the transfer system 600. At the same time, elongated tube assembly 820 moves into the opposite, open end of the garment sleeve. After the transfer is completed, the spreader and tube holding the garment sleeve are moved together to the sewing machine 702. The sewing machine is actuated and, at the same time, the tube holding the garment piece and sleeve is rotated in the direction of sewing. The cuff and sleeve are thus sewn together. The completed garment piece is then removed, bundled and taken to the next sewing station for assembly into a final garment. Details of the individual components are discussed below.

Holding Fixture

The holding fixture 300, shown in FIGS. 2–4, receives and holds the circular cuffs for placement into the garment piece. The holding fixture 300 includes a pair of cuff holders 302 which are movable relative to one another by a cuff holder drive assembly 330. The cuff holder drive assembly 330 is, in turn, mounted on a positioner 350 which is used to position the holding fixture 300.

Each cuff holder 302 includes a support post 304. A clamping block 306 is secured to the lower end of the support post 304. A support finger 312 projects outwardly from the upper end of the support post 304. The support finger 312 includes first and second portions 314 and 316. The second portion 316 has a larger diameter than the first portion 314 so that a shoulder 318 is formed between the first and second portions 314 and 316.

A finger sleeve 320 is slidably mounted on the first portion 314 of the support finger 312. The finger sleeve 320 is movable between a closed position in which one end of the finger sleeve 320 is pressed against the shoulder 318, and an open position in which the finger sleeve 320 is spaced from the shoulder 318.

The finger sleeve 320 is movable between the open position and the closed position by a cylinder 324. The cylinder 324 is mounted to the support post 304. Cylinder 324 is connected to a yoke 328. A linkage, which is pivotally mounted on a link support, connects the finger sleeve 320 to a yoke. Thus, the actuation of the cylinder 324 causes the finger sleeve 320 to move back and forth between the open position and the closed position.

The cuff holder drive assembly 330 moves the cuff holders 302 relative to one another in a transverse direction. The cuff holder drive assembly 330 is similar to the gripper drive assembly. A pair of spaced-apart belt pulleys 336 are rotatably mounted to a frame member 334. A drive belt 338 is entrained around the belt pulleys 336. One of the belt pulleys is driven by a belt motor 340. Belt motor 340 is preferably a servo-motor under the control of a programmable controller.

Each of the cuff holders 302 are clamped to the drive belt 338. The clamping block 306 of the cuff holder includes a clamping member which compresses the drive belt 338 between the clamping member 310 and clamping block 306. Each of the cuff holders 302 is clamped to a respective run of the drive belt 338. One of the cuff holders 302 is clamped to a lower run of the drive belt 338, while the opposite cuff holder 302 is clamped to the upper run of the drive belt 338. Thus, the cuff holders 302 move in opposite directions relative to one another. The clamping block 306 includes a guide channel 308 which engages with a track 332 on the frame member 334 to guide the movement of the cuff holder 302.

The holding fixture 300 is mounted on a positioner 350 which moves the holding fixture 300 in two directions and rotates the holding fixture 300. The positioner 350 includes a turntable 352 which is connected to a rotary actuator 354. The turntable 352 and rotary actuator 354 allow the holding fixture 300 to be rotated.

The turntable 352 and rotary actuator 354 are mounted to a linear slide 356. Linear slide 356 moves the holding fixture 300 in the "y" direction (i.e., perpendicular to the direction of feed of the cuff material). Linear slide 356 includes a track 358 and a slide member 360. The rotary actuator 354 is mounted on the slide member 360.

Linear slide 356 is mounted on a second linear slide 362. Linear slide 362 allows the holding fixture 300 to be moved in the "x" direction (forwardly and backwardly along the direction of feed of the cuff material). Linear slide 362 includes a track 364 and a slide member 366. Slide member 366 supports the track 358 for the first linear slide 356.

The holding fixture 300 cooperates with either a manual or automatic cuff loader (not shown). While the cuff material is being loaded, the finger sleeve 320 is normally in an open position so that the cuff material forms a cup in the space between the end of the finger sleeve 320 and the shoulder 318. After the cuff material is loaded, the finger sleeve 320 is moved to a closed position. When the finger sleeve 320 is moved to the closed position, a portion of the cuff material is pinched between the finger sleeve 320 and the shoulder 318. The finger sleeve 320 remains in a closed position while the holding fixture 300 is moved to the garment piece for positioning. The circular cuff is pinched approximately mid-way between the ends of the cuff.

Transfer System

Figure 5:
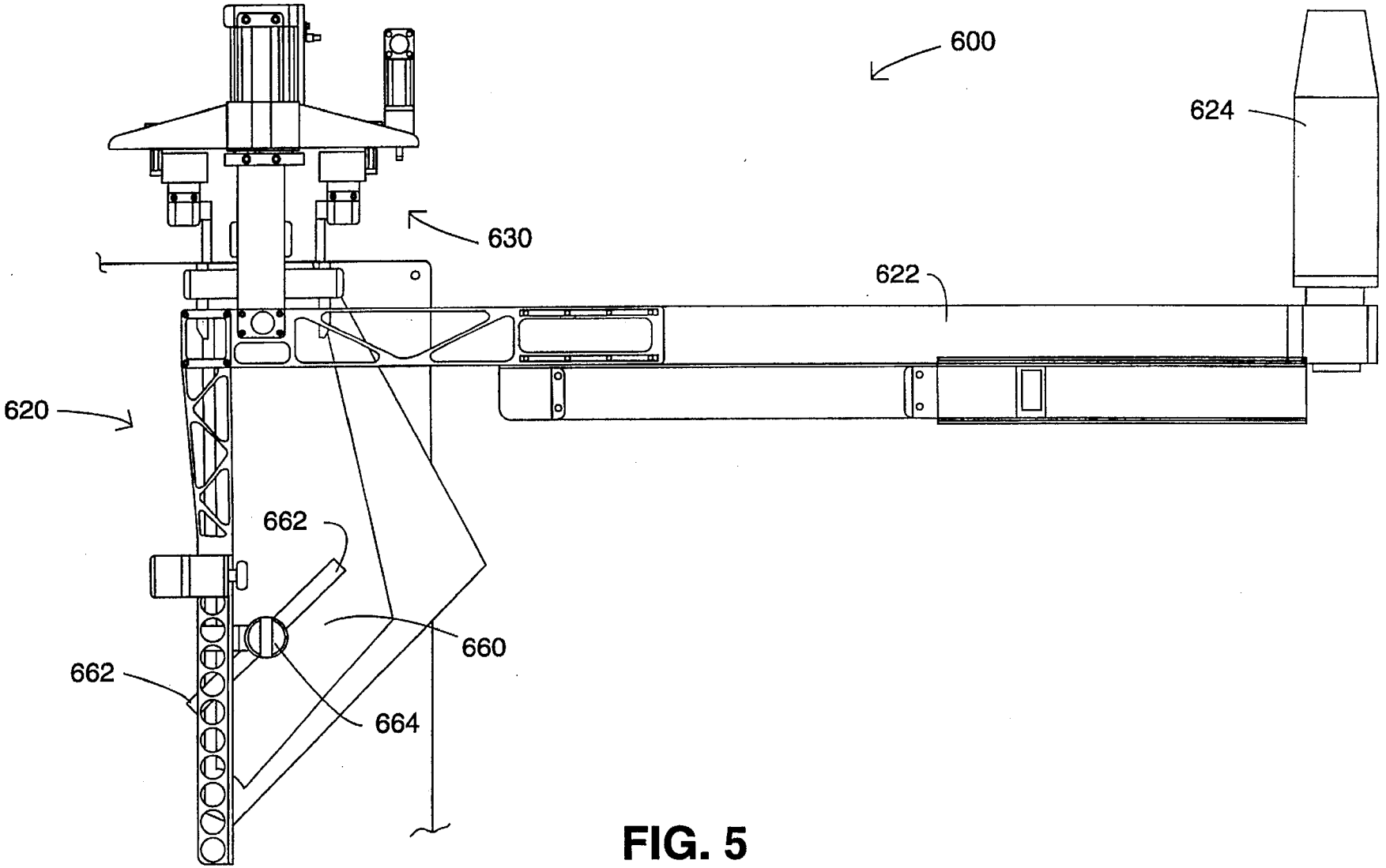
FIG. 5 is an enlarged top plan view of the transfer system.
Figure 6:
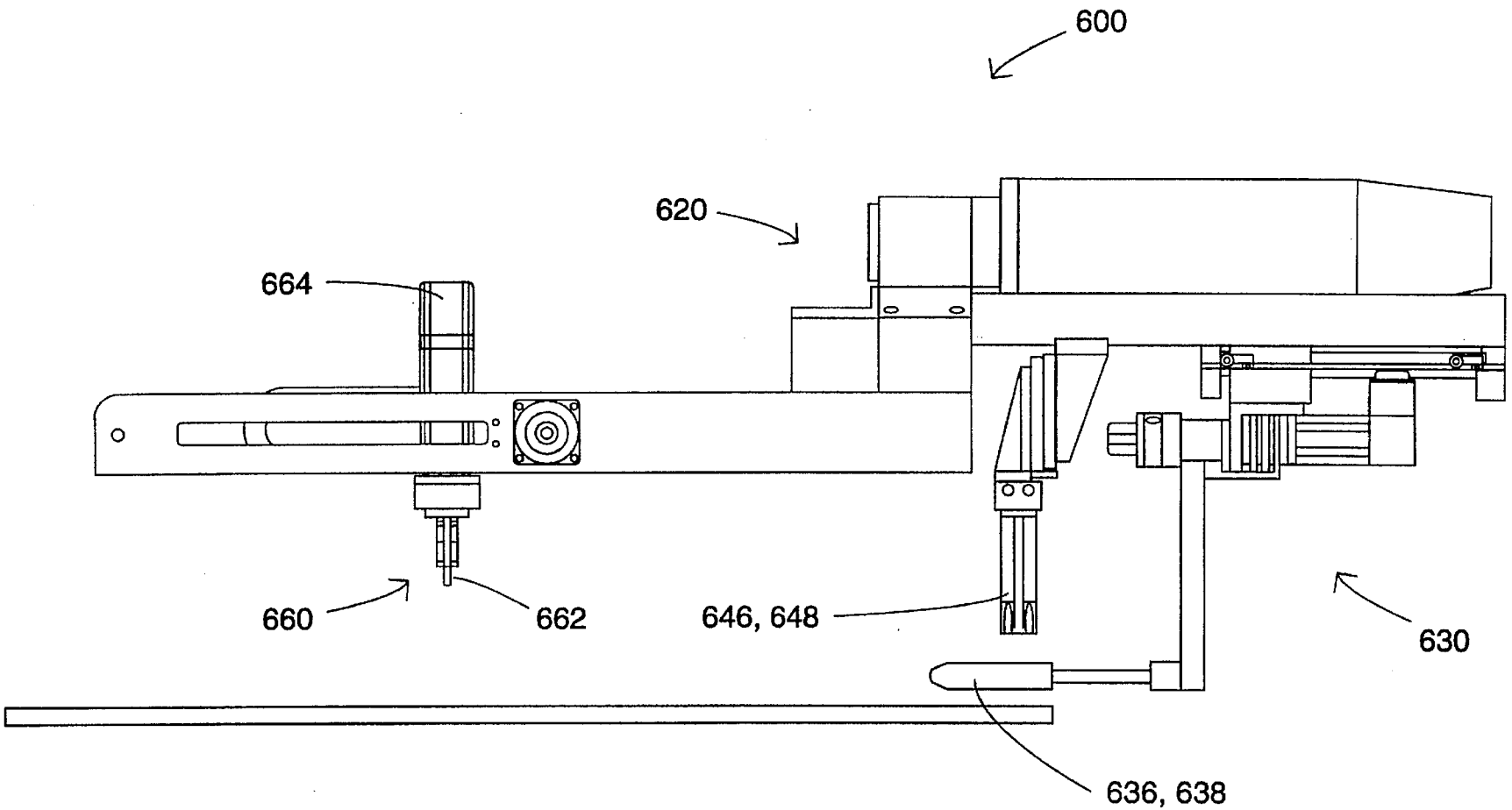
FIG. 6 is an enlarged side elevation view of the transfer system.
Figure 7:
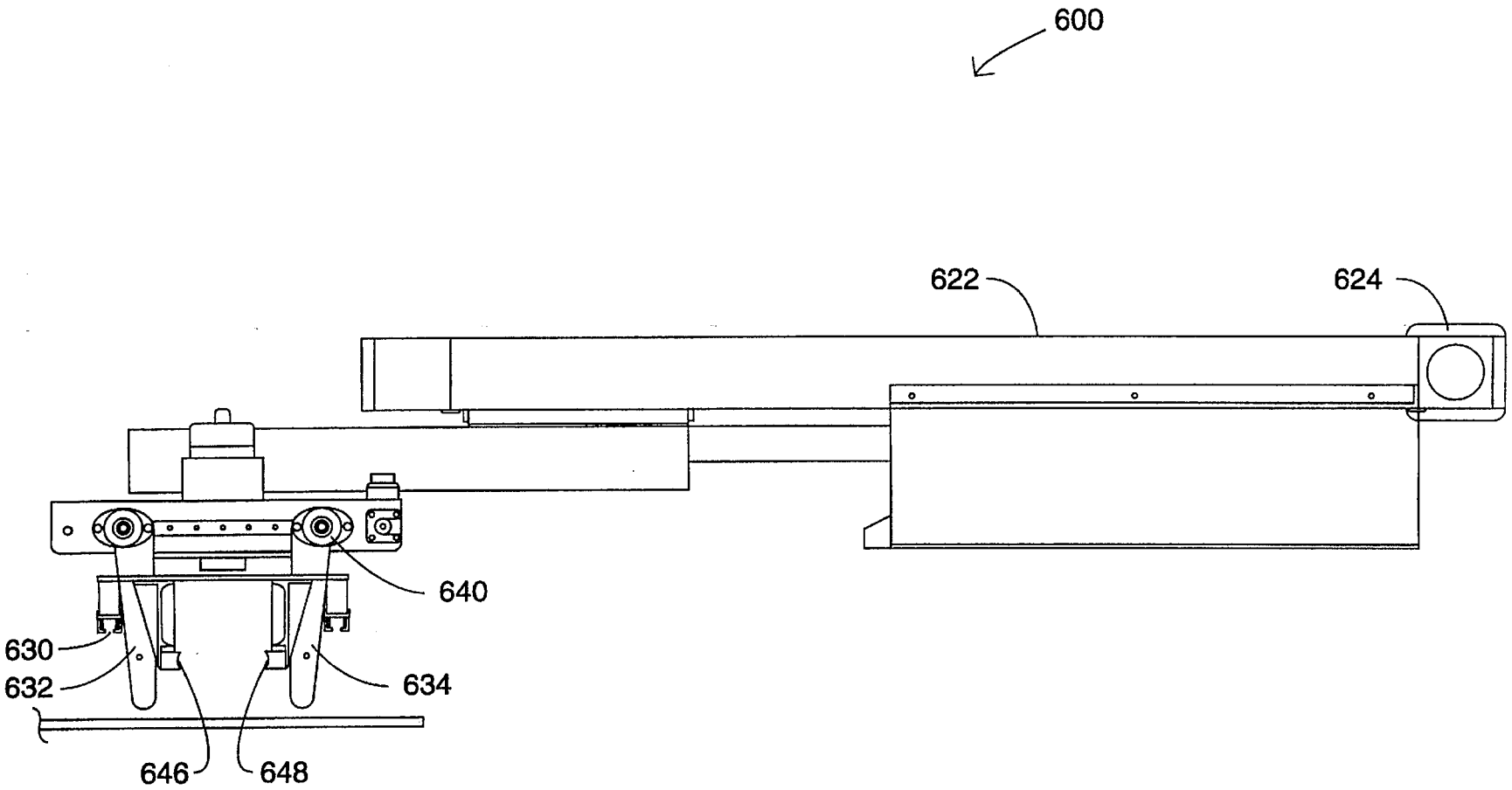
FIG. 7 is an enlarged front elevation view of the transfer system.

The transfer system 600, shown in FIGS. 5–7, moves the garment piece and circular cuffs to a sewing machine station for sewing into the garment piece. The transfer system 600 includes a frame 620 having a first pickup means 630 and second pickup means 660. As best seen in FIG. 5, frame 620 is movable between first and second positions by means of a linear slide 622 and actuator 624. This operation moves the pickup means from a first position where the garment piece and cuff are picked up to a second position where the garment piece and cuff are sewn together.

Turning to FIG. 7, first pickup means 630 includes a pair of opposed arms 632, 634. Opposed arms 632, 634 are moved into position with the cuff and garment piece by actuator means 640. Each arm 632, 634 includes semi-circular fingers 636, 638 for engaging the inner surface of the cuff and sleeve. The fingers 636, 638 are rotatable 180° between a first position away from the inside of the cuff to a second position in contact with the inside of the cuff to remove the cuff and garment piece from the holding fixture 300. In the preferred embodiment, the first pickup means also includes a pair of side grippers 646, 648 for preventing movement of the garment piece during transfer to the cuff setter.

As best seen in FIGS. 5 and 6, the second pickup means 660 includes at least one pickup head 662 connected to a vertical actuator 664 for moving the pickup head into contact with the body of the garment piece. In the preferred embodiment, a pair of pickup heads are used. Each pick-up head 662 includes an actuator having movable elements. L-shaped pinchers are secured to the movable elements of the actuator. Each pincher includes a contact surface and a gripping surface. The contact surface of the pinchers are textured so as to provide non-penetrating engagement with the sleeve material when the pick-up head 662 is lowered into contact with the sleeve. Various methods for texturing the contact surface can be used. The preferred method is to embed industrial diamonds into the contact surface. The embedded diamonds mechanically interlock with the knitted fabric without penetrating the fabric.

Cuff Setter

Figure 8:
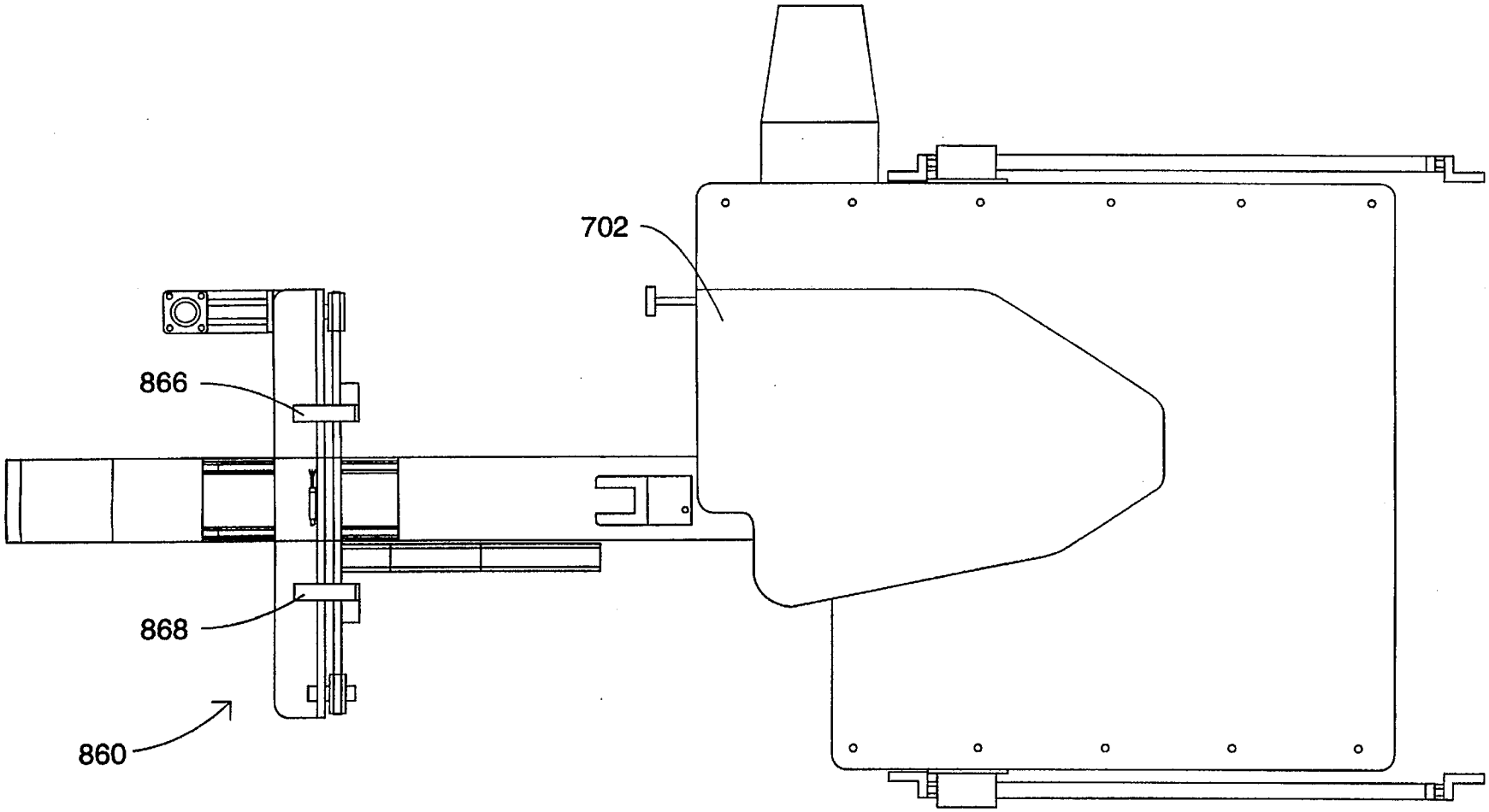
FIG. 8 is an enlarged top plan view of the cuff setter.
Figure 9:
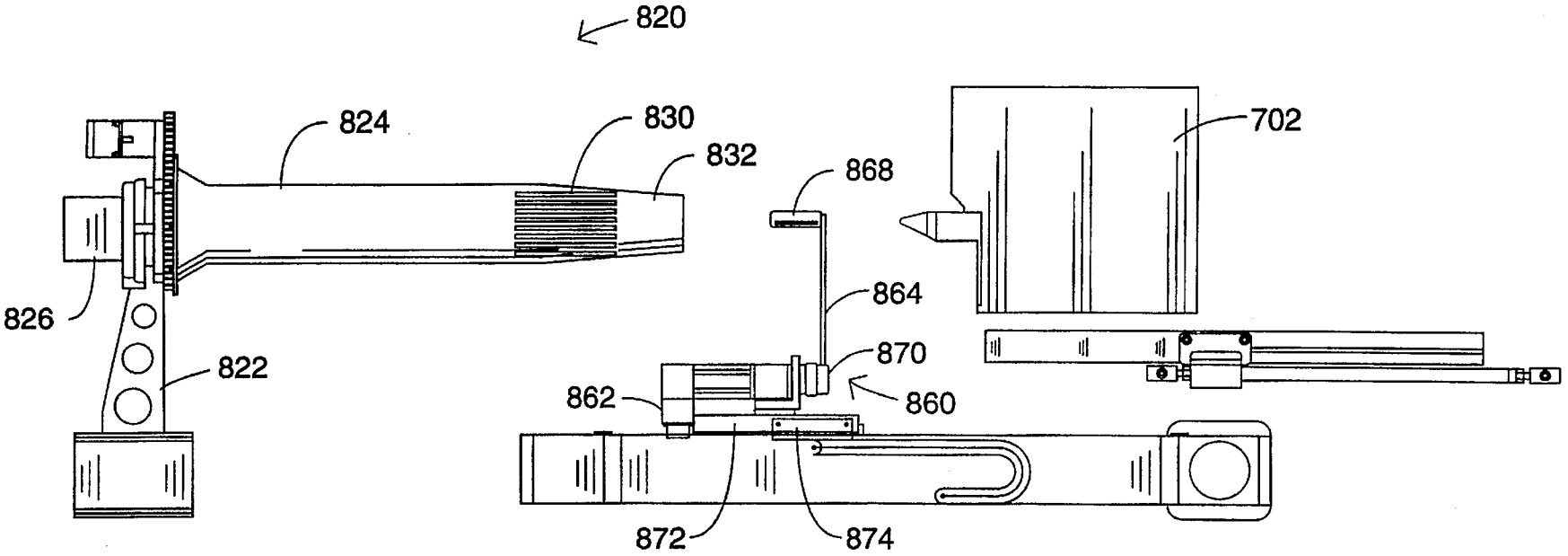
FIG. 9 is an enlarged side elevation view of the cuff setter.
Figure 10:
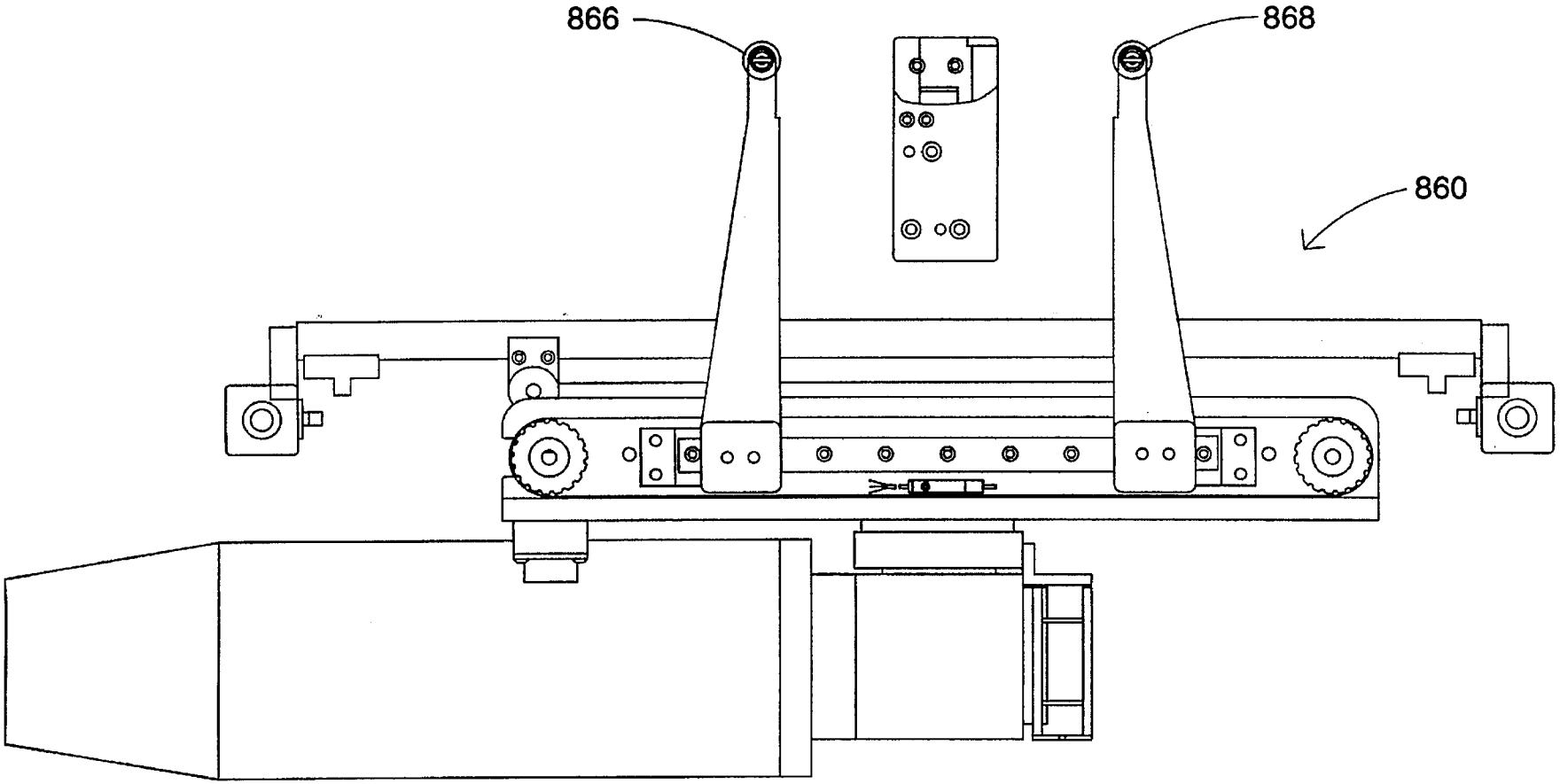
FIG. 10 is an enlarged front elevation view of the cuff setter.

The cuff setter 700, shown in FIGS. 8–10, sews the garment piece and circular cuffs together at a sewing machine station. The cuff setter 700 includes a sewing machine and an elongated tube and spreaders 800 to remove the cuff and garment piece from the transfer system 600. At the same time, elongated tube assembly 820 moves into the opposite, open end of the garment sleeve.

Elongated tube assembly 820 includes a frame 822 and an elongated plastic tube 824. A vacuum source 826 is attached to one end of the tube and a plurality of slots are arranged along the axial length of the other end of the tube 830. One type of vacuum source which is particularly suitable for the tube is a transvector Model 914, manufactured by VORTEC, Inc. of Cincinnati, Ohio. In the preferred embodiment, the end of the tube opposite the vacuum supply 832 is slightly tapered to improve the operation of the tube. Also in the preferred embodiment, the tube is made of a low friction plastic such as cellulose acetate butyrate. However, it would be expected that other materials such as polished aluminum would also work suitably well.

As best seen in FIG. 9, spreader assembly 860 includes a frame 862 having a pair of opposed arms 864. Opposed arms perpendicular rollers 866, 868 enter the cuff of the sleeve and move apart to help the gripper arm (not shown) locate and grab the cuff of the sleeve prior to inversion. A pair of rotary actuators 870 move the rollers 866, 868 from a first position close together where they can be inserted into the cuff to a second position in which the cuff is transferred, as will best be seen in FIG. 10. The frame 862 of the spreader assembly 860 is attached to a slide 872 and actuator 874 removing it between an first position away from the open-ended sleeve to a second position in which it engages the sleeve.

After the transfer is completed, the spreader and tube are moved together to the sewing machine 702. The sewing machine is actuated and, at the same time, the tube holding the garment piece and sleeve is rotated in the direction of sewing. The cuff and sleeve are thus sewn together.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. An apparatus for automatically setting a cuff to a garment piece by a sewing machine for a sweat suit or the like, said apparatus comprising:

(a) a transfer system for moving said cuff and garment piece to said sewing machine; and (b) a cuff setter including (c) an elongated tube having a front end and a rear end for receiving said garment piece over said front end of said tube and (d) a spreader assembly for engaging and spreading said cuff, (e) said cuff setter rotating said cuff and garment piece together in the direction of sewing to attach said cuff to said garment piece.

2. The apparatus according to claim 1, further including a holding fixture for holding said cuff in the garment piece prior to sewing.

3. The apparatus according to claim 2, wherein the holding fixture includes a pair of generally cylindrical fingers insertable into the end of said cuff, said fingers being movable between a closed position to facilitate insertion of the fingers into said cuff and an expanded position in which the fingers are spread apart from one another to stretch said cuff.

4. The apparatus according to claim 3, further including gripping means formed on said holding fixture for gripping said cuff between the ends thereof.

5. The apparatus according to claim 4, wherein the fingers of the holding fixture include first and second cylindrical portions which are movable relative to one another between a clamping position and a release position, and wherein said cuff is gripped between the first and second cylindrical positions when the cylindrical portions are in the clamping position.

6. The apparatus according to claim 1, wherein said spreader assembly includes a frame, a pair of opposed arms attached at one end to said frame and oriented perpendicular to the axis of said tube, and means for moving said pair of opposed arms between a first position adjacent to one another and a second position apart from one another.

7. The apparatus according to claim 6, wherein said means for moving said pair of opposed arms between a first position adjacent to one another and a second position apart from one another includes a pair of rotary actuators attached to said frame and to said pair of opposed arms.

8. The apparatus according to claim 6, wherein said pair of opposed arms further includes a gripping finger attached to the other end of each of said opposed arms for engaging said garment piece.

9. The apparatus according to claim 1, further including means for moving said spreader assembly from a first position away from the front end of said tube to a second position adjacent to the front end of said tube.

10. The apparatus according to claim 9, wherein said means for moving said spreader means from a first position away from the front end of said tube to a second position adjacent to the front end of said tube includes a slide attached to a frame and an actuator attached between said slide and said frame.

11. The apparatus according to claim 1, wherein the front end of said tube is tapered.

12. The apparatus according to claim 1, wherein said tube is formed of low-friction plastic.

13. The apparatus according to claim 1, further including a source of vacuum attached to the rear end of said tube.

14. The apparatus according to claim 13, wherein said source of vacuum attached to the rear end of said tube is a transvector.

15. The apparatus according to claim 13, wherein the front end of said tube includes a plurality of slots.

16. The apparatus according to claim 15, wherein said plurality of slots are axially aligned with respect to said tube.

17. A transfer system for an apparatus for automatically setting a cuff to a garment piece by a sewing machine for a sweat suit or the like for moving said cuff and garment piece to said sewing machine, said apparatus comprising:

(a) a frame;

(b) a first gripping means attached to said frame for engaging said cuff and said garment piece adjacent to said cuff; and (c) a second gripping means attached to said frame for engaging said garment piece opposite said cuff, whereby said first and second gripping means cooperate to move said cuff and garment piece together to said sewing machine.

18. The apparatus according to claim 17, wherein said first gripping means attached to said frame for engaging said cuff and said garment piece adjacent to said cuff includes a pair of opposed arms having an actuator means attached to one end of each of said arms and a cuff and garment piece engaging finger attached to the other end of each of said arms.

19. The apparatus according to claim 18, wherein said first gripping means further includes side grippers located adjacent to each of said fingers for gripping said cuff and garment piece between each of said side grippers and said fingers to prevent movement between said cuff and garment piece.

20. The apparatus according to claim 18, wherein each of said cuff and garment piece engaging fingers attached to the other end of each of said arms is an elongated tube mounted perpendicular to said arm at one end and having a semicircular cross section extending from about its midportion to the opposite end and further including means for simultaneously rotating each of said fingers about its longitudinal axis in a direction opposite to one another between a first cuff and garment piece engaging position and a second cuff and garment piece releasing position.

21. The apparatus according to claim 17, wherein said second gripping means attached to said frame for engaging said garment piece opposite said cuff includes a vertical actuator attached at one end to said frame, an elongated horizontal support member attached to the other end of said vertical actuator and a pair of pickup heads attached to each end of said horizontal support member.

22. The apparatus according to claim 21, wherein each of said pickup heads attached to each end of said horizontal support member includes a pair of opposed jaws for engaging said garment piece.

23. The apparatus according to claim 22, wherein the surface of each of said pair of opposed jaws for engaging said garment piece is imbedded with diamond particles to improve the surface contact between said jaws and said garment piece.

24. An apparatus for automatically setting a cuff to a garment piece by a sewing machine for a sweat suit or the like, said apparatus comprising:

(a) a holding fixture for holding said cuff in the garment piece prior to sewing;

(b) a transfer system for moving said cuff and garment piece to said sewing machine, said transfer system including: (i) a frame; (ii) a first pickup means attached to said frame for engaging said cuff and said garment piece adjacent to said cuff; and (iii) a second pickup means attached to said frame for engaging said garment piece opposite said cuff, whereby said first and second pickup means cooperate to move said cuff and garment piece together to said sewing machine; and (c) a cuff setter including an elongated tube having a front end and a rear end for receiving said garment piece over said front end of said tube and a spreader assembly for moving said cuff and garment piece together in the direction of sewing to attach said cuff to said garment.

25. The apparatus according to claim 24, wherein the holding fixture includes a pair of generally cylindrical fingers insertable into the end of said cuff, said fingers being movable between a closed position to facilitate insertion of the fingers into said cuff and an expanded position in which the fingers are spread apart from one another to stretch said cuff.

26. The apparatus according to claim 25, further including gripping means formed on said holding fixture for gripping said cuff between the ends thereof.

27. The apparatus according to claim 26, wherein the fingers of the holding fixture include first and second cylindrical portions which are movable relative to one another between a clamping position and a release position, and wherein said cuff is gripped between the first and second cylindrical positions when the cylindrical portions are in the clamping position.

28. The apparatus according to claim 24, wherein said spreader means includes a frame, a pair of opposed arms attached at one end to said frame and oriented perpendicular to the axis of said tube, and means for moving said pair of opposed arms between a first position adjacent to one another and a second position apart from one another.

29. The apparatus according to claim 28, wherein said means for moving said pair of opposed arms between a first position adjacent to one another and a second position apart from one another includes a pair of rotary actuators attached to said frame and to said pair of opposed arms.

30. The apparatus according to claim 28, wherein said pair of opposed arms further includes a gripping finger attached to the other end of each of said opposed arms for engaging said garment piece.

31. The apparatus according to claim 24, further including means for moving said spreader means from a first position away from the front end of said tube to a second position adjacent to the front end of said tube.

32. The apparatus according to claim 31, wherein said means for moving said spreader means from a first position away from the front end of said tube to a second position adjacent to the front end of said tube includes a slide attached to said frame and an actuator attached between said slide and said frame.

33. The apparatus according to claim 24, wherein the front end of said tube is tapered.

34. The apparatus according to claim 24, wherein said tube is formed of low-friction plastic.

35. The apparatus according to claim 24, further including a source of vacuum attached to the rear end of said tube.

36. The apparatus according to claim 35, wherein said source of vacuum attached to the rear end of said tube is a transvector.

37. The apparatus according to claim 35, wherein the front end of said tube includes a plurality of slots.

38. The apparatus according to claim 37, wherein said plurality of slots are axially aligned with respect to said tube.

39. The apparatus according to claim 24, wherein said first pickup means attached to said frame for engaging said cuff and said garment piece adjacent to said cuff includes a pair of opposed arms having an actuator means attached to one end of each of said arms and a cuff and garment piece engaging finger attached to the other end of each of said arms.

40. The apparatus according to claim 39, wherein said first pickup means further includes a side grippers located adjacent to each of said fingers for gripping said cuff and garment piece between each of said side grippers and said fingers to prevent movement between said cuff and garment piece.

41. The apparatus according to claim 39, wherein each of said cuff and garment piece engaging fingers attached to the other end of each of said arms is an elongated tube mounted perpendicular to said arm at one end and having a semicircular cross section extending from about its midportion to the opposite end and further including means for simultaneously rotating each of said fingers about its longitudinal axis in a direction opposite to one another between a first cuff and garment piece engaging position and a second cuff and garment piece releasing position.

42. The apparatus according to claim 24, wherein said second pickup means attached to said frame for engaging said garment piece opposite said cuff includes a vertical actuator attached at one end to said frame, an elongated horizontal support member attached to the other end of said vertical actuator and a pair of pickup heads attached to each end of said horizontal support member.

43. The apparatus according to claim 42, wherein each of said pickup heads attached to each end of said horizontal support member includes a pair of opposed jaws for engaging said garment piece.

44. The apparatus according to claim 43, wherein the surface of each of said pair of opposed jaws for engaging said garment piece is imbedded with diamond particles to improve the surface contact between said jaws and said garment piece.

45. A method for automatically setting a cuff to a garment piece for a sweat suit or the like, said method comprising the steps of:

(a) moving said cuff and garment piece to said sewing machine by a transfer system;

(b) receiving said garment piece over a front end of an elongated tube having a front end and a rear end;

(c) spreading said cuff by a spreader assembly;

(d) rotating said cuff and garment piece together in the direction of sewing to attach said cuff to said garment by a spreader assembly.

46. A method for automatically setting a cuff to a garment piece for a sweat suit or the like, said method comprising the steps of:

(a) holding said cuff in the garment piece prior to sewing in a holding fixture;

(b) moving said cuff and garment piece to said sewing machine by a transfer system, said transfer system including: (i) a frame; (ii) a first pickup means attached to said frame for engaging said cuff and said garment piece adjacent to said cuff; and (iii) a second pickup means attached to said frame for engaging said garment piece opposite said cuff, whereby said first and second pickup means cooperate to move said cuff and garment piece together to said sewing machine; and (c) receiving said garment piece over a front end of an elongated tube having a front end and a rear end;

(d) spreading said cuff by a spreader assembly;

(e) rotating said cuff and garment piece together in the direction of sewing to attach said cuff to said garment by a spreader assembly.

* * * * *